US006661173B2

(12) United States Patent
Koenigsberg et al.

(10) Patent No.: US 6,661,173 B2
(45) Date of Patent: Dec. 9, 2003

(54) QUARTZ ARC TUBE FOR A METAL HALIDE LAMP AND METHOD OF MAKING SAME

(75) Inventors: William D. Koenigsberg, Concord, MA (US); Miguel Galvez, Danvers, MA (US); Gregory Zaslavsky, Marblehead, MA (US); Zeya Krasko, Peabody, MA (US); Joseph V. Lima, Salem, MA (US)

(73) Assignee: Osram Sylvania Inc., Danvers, MA (US)

( * ) Notice: Subject to any disclaimer, the term of this patent is extended or adjusted under 35 U.S.C. 154(b) by 78 days.

(21) Appl. No.: 09/963,760

(22) Filed: Sep. 26, 2001

(65) Prior Publication Data

US 2003/0057836 A1 Mar. 27, 2003

(51) Int. Cl.[7] ..... H01J 17/16; H01J 61/18; H01J 61/33

(52) U.S. Cl. ..... 313/634; 313/573; 313/638

(58) Field of Search ..... 313/634, 637, 313/638, 636, 231.71, 571, 573, 25, 620; 315/291

(56) References Cited

U.S. PATENT DOCUMENTS

| | | | | | |
|---|---|---|---|---|---|
| 3,619,682 | A | * | 11/1971 | Lo et al. | 313/22 |
| 3,947,714 | A | | 3/1976 | Rehder et al. | 313/225 |
| 5,055,740 | A | * | 10/1991 | Sulcs | 313/634 |
| 5,101,134 | A | * | 3/1992 | Rothwell, Jr. et al. | 313/44 |
| 5,128,589 | A | * | 7/1992 | Dakin | 313/634 |
| 5,334,906 | A | * | 8/1994 | Muzeroll | 313/25 |
| 5,424,609 | A | | 6/1995 | Geven et al. | 313/623 |
| 5,694,002 | A | | 12/1997 | Krasko et al. | 313/641 |
| 5,751,111 | A | | 5/1998 | Stoffels et al. | 313/606 |
| 6,124,683 | A | | 9/2000 | Olsen et al. | 315/291 |

* cited by examiner

*Primary Examiner*—Nimeshkumar D. Patel
*Assistant Examiner*—Karabi Guharay
(74) *Attorney, Agent, or Firm*—Robert F. Clark

(57) ABSTRACT

A quartz arc tube for a metal halide lamps and its method of making are described. The quartz arc tube has a cylindrical design which promotes a nearly symmetric longitudinal surface temperature profile during operation. The profile has a maximum temperature of about 900° C. which allows for longer operating life at high average wall loadings.

7 Claims, 2 Drawing Sheets

QUARTZ ARC TUBE FOR A METAL HALIDE LAMP AND METHOD OF MAKING SAME

TECHNICAL FIELD

This invention is related to arc tubes used in metal halide discharge lamps. More particularly, this invention is related to cylindrical quartz arc tubes for metal halide lamps.

BACKGROUND OF THE INVENTION

Low wattage metal halide lamps (35–150 Watts) are potential candidates to replace incandescent lamps in general lighting and commercial display applications because they offer higher efficacy and longer life. However, compared to incandescent lamps, low wattage metal halide lamps frequently exhibit inferior color rendering and variable (lamp-to-lamp) color consistency. Therefore, alternative design approaches are being sought to address the color deficiencies, without sacrificing the high efficacy and long life.

In commercial metal halide lamps, the arc tube is made from a section of quartz tubing. Each end of the quartz tube is pinched between a pair of opposed jaws to form a gas-tight seal about an electrode assembly while the quartz is in a heat-softened condition. As a result of this pinch-seal process, the ends become somewhat deformed and rounded between the cylindrical main body of the arc tube and the flattened press seal area. The curved shape of these end wells may vary with the diameter and wall thickness of the original quartz tubing, the heat concentration during processing, and the pressure of the enclosed inert gas during pressing.

The photometric performance parameters of metal halide lamps are dependent on the partial pressures of the enclosed metal halide salts. Their vapor pressures are primarily controlled by the arc tube wall temperature in the region where the metal halide vapors condense. This zone is usually located in the lowest portion of the arc tube due to gravity and internal gas convection flow. The temperature of this so-called "cold zone" should be high enough to provide sufficient evaporation of the radiating metal halide species. However, the temperature cannot be too high otherwise the long life of the arc tube will be compromised due to chemical reactions with the wall or devitrification of the quartz. Therefore, a nearly uniform wall temperature distribution (not exceeding about 900° C. for quartz) is desirable for a useful life of more than about 6000 hours. The 900° C. wall temperature is high enough for evaporating many metal halide salts and low enough to realize a useful life of the arc tube. In the case of lamps that use quartz arc tubes, lamp life typically is reduced by a factor of two for every 50° C. increase over 900° C.

One of the known means for realizing a more uniform wall temperature distribution is applying a heat-conserving coating, such as zirconium oxide, to the outside surface of the end wells of the arc tube. Most conventional metal halide lamps utilize this heat-conserving coating on one or both ends of the arc tube. Apart from being an additional cost component, the coating is itself a significant source of variability in the photometric performance of such lamps because of intrinsic lamp-to-lamp variation in coating height, adhesion properties, and its tendency to discolor.

A more effective but more costly way of obtaining a nearly uniform wall temperature distribution is to form discharge vessels in elliptical or pear-shaped bodies for vertically operated lamps or arched tubes for horizontal operation. However, this method does not generally provide for universal operation of the lamp (i.e., a lamp oriented arbitrarily with respect to gravity), and requires time consuming glass-working steps that are not needed for straight tubular body arc tubes.

High arc loading (W/cm) and wall loading (W/cm$^2$) are critical for improved performance in low wattage metal halide lamps. Typically, for 35W to 150W quartz-body arc tubes of conventional design, average electrical wall loading does not exceed 20 W/cm$^2$ (or 100 W/cm arc loading) in order to obtain an operating life of greater than about 6000 hours. These empirically determined limits result from the fact that at elevated loading the temperatures on the arc tube wall become too high for quartz to survive through the desired life. To remain within these loading limits, lamp designers have adjusted the arc chamber size and shape, specifically, the electrode insertion length, lamp cavity length, and lamp diameter in elliptical or ellipsoidal design arc tubes. Additional control of temperature distributions and levels in metal halide lamps has been exercised by changes in the arc tube fill chemistry.

Cylindrical quartz arc tubes with conservatively low wall loadings (10–13 W/cm$^2$) were rejected in the early days (1960's) of metal halide lamp development because they did not provide adequate efficiency in low wattage lamps. Nearly symmetric longitudinal, outer surface temperature profiles have been achieved with ceramic arc tubes having a right circular cylindrical shape, e.g., U.S. Pat. Nos. 5,424,609 and 5,751,111. However, the operating temperatures of ceramic arc tubes is typically above 975° C. which far exceeds the 900° C. limit for quartz arc tubes.

SUMMARY OF THE INVENTION

It is an object of the invention to obviate the disadvantages of the prior art.

It is another object of the invention to provide a quartz arc tube for a metal halide lamp which can be operated at a high average wall loading without exceeding a maximum surface temperature of the discharge chamber of about 900° C.

It is yet another object of the invention to provide a quartz arc tube for a metal halide lamp which has a nearly symmetric longitudinal surface temperature profile when operating at a steady-state thermal condition.

It is still another object of the invention to provide a method for making quartz arc tubes for a metal halide lamps having these desirable properties.

In accordance with one object of the invention, there is provided a quartz arc tube for a metal halide lamp comprising a quartz body enclosing a discharge chamber having a metal halide fill, the discharge chamber having substantially the shape of a right circular cylinder and containing opposing electrodes, the discharge chamber having a nearly symmetric longitudinal surface temperature profile when operating in a steady-state thermal condition wherein the difference between the maximum and minimum temperatures of the profile is less than about 30° C. and the maximum temperature of the profile is less than about 900° C.

In accordance with another object of the invention, there is provided a quartz arc tube for a metal halide lamp comprising a quartz body enclosing a discharge chamber having a metal halide fill, the discharge chamber having substantially the shape of a right circular cylinder and containing opposing electrodes, the opposing electrodes being disposed at each end of the discharge chamber and coaxial with the axis of the chamber, the distance between the opposing electrodes defining an arc length, the inner diameter of the discharge chamber in centimeters being approximately equal to $[(1+P/50)^{1/2}-1]$, where P is the input power in watts, and wherein the ratio of the arc length to the inner diameter is about one.

In accordance with yet another object of the invention, there is provided a method of making a quartz arc tube for a metal halide lamp, the quartz arc tube having a quartz body enclosing a discharge chamber having a metal halide fill, the discharge chamber having substantially the shape of a right circular cylinder and containing opposing electrodes, the opposing electrodes being disposed at each end of the discharge chamber and coaxial with the axis of the chamber, the distance between the opposing electrodes defining an arc length, the discharge chamber having a pierce point where each corresponding electrode enters the discharge chamber, the distance between the pierce point and the corresponding electrode end within the discharge chamber defining an electrode insertion length, the arc tube when operating in a steady-state thermal condition having a longitudinal surface temperature profile, the method comprising the steps of:

a) selecting an arc length and an inner diameter for the discharge chamber wherein the inner diameter in centimeters is greater than $[(1+P/50)^{1/2}-1]$, where P is the input power in watts, and wherein the ratio of the arc length to the inner diameter is about one;

b) forming the arc tube;

c) operating the arc tube at a predetermined average wall loading to obtain a steady-state thermal condition;

d) measuring a longitudinal surface temperature profile of the discharge chamber to obtain a maximum temperature and minimum temperature;

e) repeating steps b) to d) while incrementally decreasing the inner diameter of the discharge chamber with each iteration until the maximum temperature of the longitudinal surface temperature profile is midway between the ends of the discharge chamber; and f) repeating steps b) to d) while incrementally varying the electrode insertion length with each iteration until the difference between the minimum temperature and the maximum temperature of the profile is minimized without causing the maximum temperature to exceed about 900° C.

DESCRIPTION OF PREFERRED EMBODIMENTS

Figure 1:
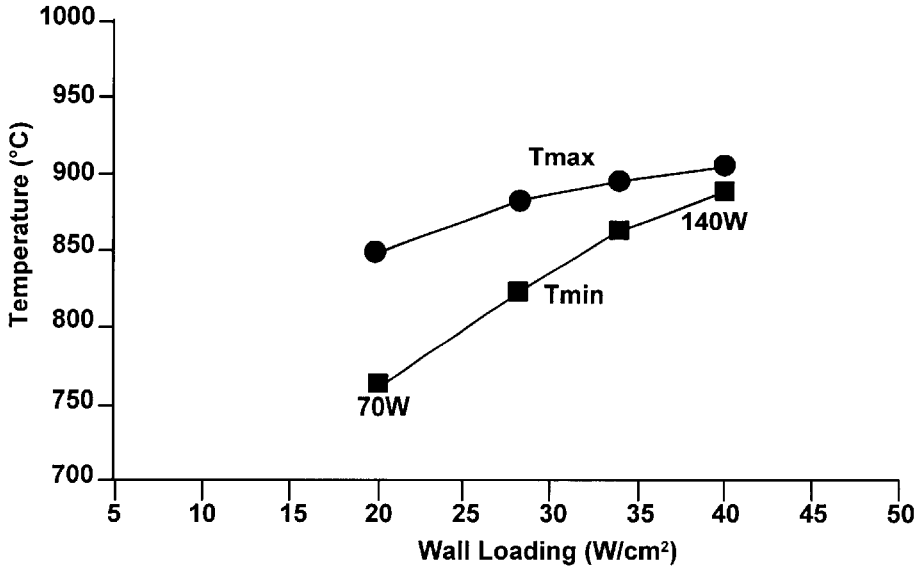
FIG. 1 is a graphical representation of cold and hot spot temperatures of an operating quartz arc tube of this invention as a function of wall loading.

For a better understanding of the present invention, together with other and further objects, advantages and capabilities thereof, reference is made to the following disclosure and appended claims taken in conjunction with the above-described drawings.

For quartz arc tubes used in metal halide lamps, and in particular low wattage metal halide lamps, we have discovered that a cylindrical discharge chamber having a specific geometry and diameter yields unexpected thermal performance and photometric benefits which allow metal halide lamps to successfully function at high average wall loadings of from about 25 to about 40 W/cm$^2$ without exceeding the arc chamber's maximum allowed wall temperature of about 900° C. More particularly, the discharge chamber of the quartz arc tube of this invention has substantially the form of a right circular cylinder. After reaching a steady-state thermal condition when operating, the quartz arc tubes of this invention exhibit a substantially symmetric and nearly isothermal longitudinal surface temperature profile as viewed along the axis of the discharge chamber without exceeding the maximum allowed temperature of about 900° C. As defined herein, the longitudinal surface temperature profile is determined along the axis of the barrel portion of the cylindrical discharge chamber after the arc tube has reached a steady-state thermal condition during operation. Preferably, the difference between the maximum and minimum temperatures of the profile is less than about 30° C., and more preferably less than about 20° C. In addition, the operating arc tubes exhibit high efficacy, good color rendering (preferably a CRI of greater than about 80), and improved color control for universal operation. An additional advantage of the cylindrical arc tube according to the present invention is that the end paint that is conventionally used to reduce heat loss from the end wells of prior-art arc tubes is not needed. This manufacturing and economic advantage is a direct consequence of the geometrically induced reduction of the temperature gradient along the outer surface of the discharge chamber.

Central to the design of the cylindrical quartz arc tube is the specification of the diameter of the barrel portion of the discharge chamber. It must be chosen sufficiently small so that heat transfer from the plasma arc to the chamber wall by gaseous convection is substantially reduced in comparison with that of quartz arc tubes of conventional design. Satisfaction of this condition can be ascertained by measuring the steady-state temperature distribution on the surface of the outer wall of a vertically operating cylindrical quartz arc tube. When the diameter is too large, the maximum temperature on the outer wall of the cylindrical chamber will occur near the upper end of the cylindrical barrel portion, because of substantial convective heat transport from the plasma arc to the wall. Consequently, the longitudinal surface temperature profile of the discharge chamber will not exhibit central (mirror-plane) symmetry. This asymmetric thermal characteristic indicates that heat transfer from the arc to the wall within the cylindrical discharge chamber is dominated by gaseous convection. As the diameter of the cylindrical discharge chamber is decreased, the location of the maximum wall chamber temperature migrates toward the middle region of the barrel portion, indicating a transition from heat transfer dominated by gaseous convection to one dominated by thermal conduction. This is a consequence of the concomitant reduction of the velocity of the hot gas convecting within the arc tube. When this occurs, the longitudinal surface temperature profile of the discharge chamber will exhibit a high degree of central symmetry.

The arc tubes described herein are designed for universal operation, i.e., operation which is independent of the orientation of the arc tube with respect to gravity. The arc tube examples provided herein were operated in a vertical orientation. In general, the plasma arc in an arc tube operated in a nonvertical orientation tends to bow upwards because of buoyancy forces induced by temperature gradients within the plasma arc. However, it is known that an acoustically modulated input-power waveform can be used to achieve straightened arcs in arc tubes operated in nonvertical orientations, e.g., as described in U.S. Pat. No. 6,124,683 which is incorporated by reference. Therefore, it is believed that the advantages of this invention may be achieved in an arc tube operating in a nonvertical orientation if acoustic modulation techniques are used to maintain a straight arc.

The hot-spot and cold-spot temperatures as a function of average electrical wall loading (watts/cm$^2$) for a group of cylindrical quartz arc tubes designed according to this invention are shown in FIG. 1. As expected, the cold-spot temperature (Tmin) increased rapidly with increased wall loading, resulting in improved efficacy, better color rendering and usually lower color temperature. Surprisingly, the hot-spot temperature (Tmax) increased at a markedly decreasing rate, thereby exhibiting a 'soft saturation' characteristic. The peak surface temperature of the barrel portion of the cylindrical discharge chamber reached only 890° C. at the very high wall loading of 40 W/cm$^2$. The combination of these two effects, i.e., the behavior of the hot- and cold-spot temperatures with increased average wall loading, is directly responsible for the improved thermal and photometric performance. This behavior does not occur with prior-art quartz arc tubes because their barrel diameters are too large.

In this example, the temperature difference between the coldest and the hottest spots on the barrel of the cylindrical chamber approached about 20° C., rendering the arc tube surface nearly isothermal. In thermal equilibrium, an isothermal surface at temperature $T_0$ radiates less power than a non-isothermal surface (with the same area and radiative material properties) having an average temperature of $T_0$. Therefore, an arc tube with a nearly isothermal surface temperature operates more efficiently (thermal losses are reduced or minimized) than an arc tube having a surface temperature distribution which is less uniform.

Figure 2:
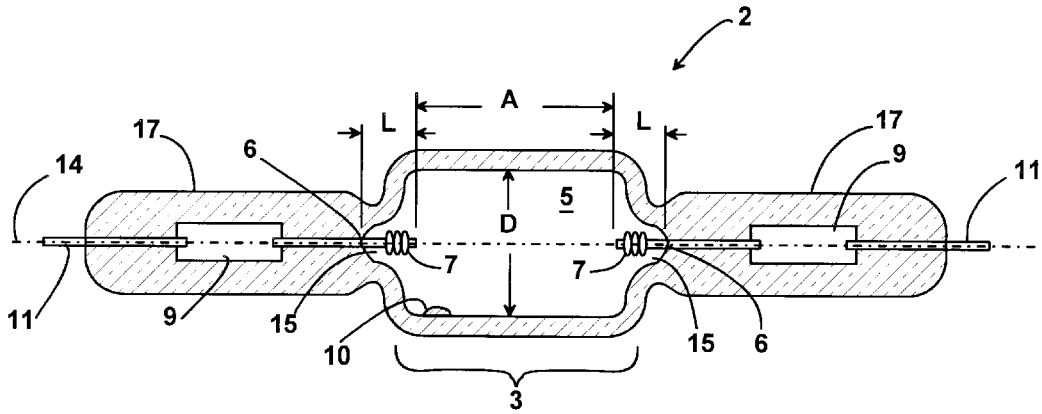
FIG. 2 is a diagram of a quartz arc tube of this invention.

Referring to FIG. 2, in a preferred embodiment, the quartz arc tube 2 has discharge chamber 5 containing metal halide fill 10. Discharge chamber 5 has substantially the form of a right circular cylinder within the practical limits for conventional roller forming of the quartz envelope. The discharge chamber has barrel portion 3 having an inner diameter D. Electrodes 7 are disposed at each end of discharge chamber 5 and are coaxial with axis 14 of discharge chamber 5. The distance between the ends of the opposing electrodes 7 defines arc length A. The electrodes 7 are further located in end wells 15 which are formed at each end of the discharge chamber. The end wells 15 exhibit rotational symmetry because of the basic cylindrical shape produced in the roller-forming operation. The end wells 15 resemble a radially-compressed bottleneck exhibiting circular symmetry at the ends of the arc chamber. The distance between pierce point 6 (the point where the electrode enters the end well) and the tip of the electrode defines electrode insertion length L. Electrodes 7 are welded to molybdenum foils 9 which are in turn welded to leads 11. The leads 11 are connected to an external power supply (not shown) which provides the electrical power to ignite and sustain an arc discharge between electrodes 7. The molybdenum foils 9 are hermetically sealed in the quartz by means of press seals 17 located at each end of arc tube 2.

If for a given lamp input power P (in watts) an average wall loading of 30 W/cm$^2$ is assumed and the aspect ratio of arc length A to the inner diameter D of the barrel portion of the cylindrical discharge chamber is equal to about one (A/D≡1), the inner diameter of the discharge chamber, D (in cm), as a first approximation, is governed by the formula:

$$D \equiv (1+P/50)^{1/2}-1$$

To optimize the diameter, it is preferred to start with an arc tube whose inner diameter is somewhat larger than that specified by the formula cited above. As the diameter is decreased, the zone (on the outer surface of the cylindrical body) containing the maximum temperature (hot spot) gradually migrates toward a position midway between both ends of the discharge chamber.

Decreasing the diameter further does not affect the location of this hot zone, but does cause its peak temperature to increase. In general, the optimized diameter occurs at the point where the most nearly symmetric longitudinal surface temperature profile is reached, while simultaneously satisfying the condition that its maximum temperature does not exceed about 900° C.

After the arc tube diameter is determined, adjustments are made to the design to further optimize performance. In particular, the electrode insertion length and the shape of the end well may be adjusted so that the cold-spot temperature on the surface of the barrel portion is as high as possible without exceeding the maximum temperature of the hot zone (located on the surface of the barrel portion nearly midway between the two end wells). Satisfaction of this requirement can be ascertained by measuring the steady-state longitudinal temperature distribution on the surface of the wall of a vertically operating arc tube. When the insertion length is increased, the cold-spot temperature (typically observed at each end of the barrel portion of the cylindrical discharge chamber) decreases. The optimized insertion length is the one that maximizes the cold spot temperature at either end of the cylindrical barrel (for a given end well shape) without exceeding the maximum temperature of the hot zone, while simultaneously preserving the central symmetry of the longitudinal surface temperature profile of the cylindrical discharge chamber.

Figure 3:
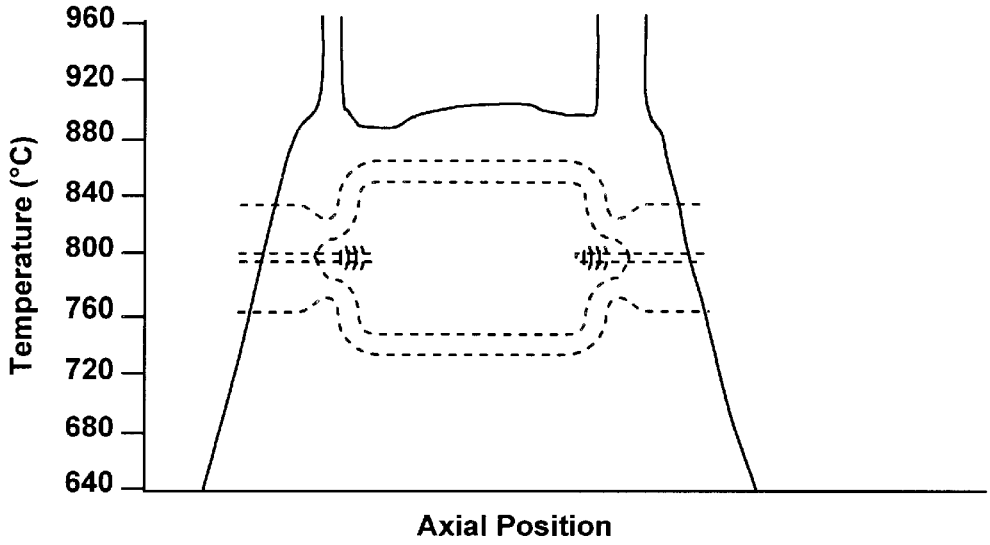
FIG. 3 is a surface temperature profile of an operating quartz arc tube of this invention.

A surface temperature profile for a vertically operated cylindrical quartz arc tube designed according to the present invention is shown in FIG. 3. A dotted-line representation of a cylindrical arc tube has been superimposed on the temperature profile to show the approximate spatial relationship between the profile and the arc tube. The profile includes the region of the arc tube beyond the barrel portion of the discharge chamber. The temperature profile was measured with an AGEMA thermovision 900 infrared imaging system at 5.0 micron wavelength with a close-up lens to enhance resolution and clarity.

Figure 4:
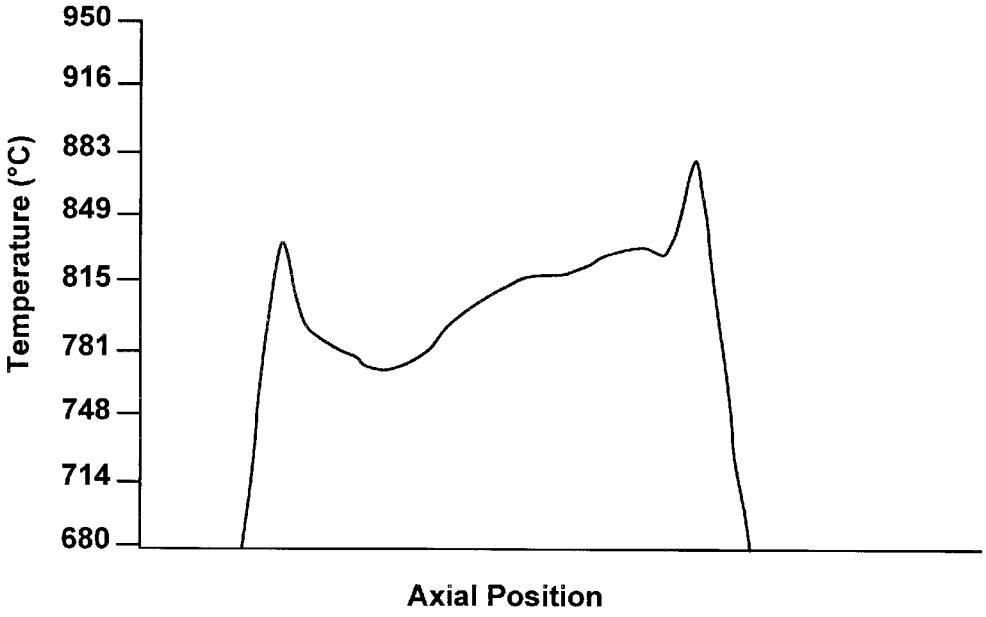
FIG. 4 (Prior Art)
FIG. 4 is a surface temperature profile of an operating prior art quartz arc tube.

The difference between the maximum and minimum temperatures for the surface of the barrel portion of the discharge chamber is about 20° C. Temperature spikes occur at either end of the arc tube at the pierce points where the electrodes enter the end wells. These pierce points are outside of the barrel portion of the cylindrical discharge chamber and do not significantly affect arc tube performance because they occur over a very small region where the metal salt doesn't reside. The longitudinal surface temperature profile which is determined along the axis of the barrel portion of the cylindrical discharge chamber shows a high degree of central symmetry. This is to be compared with a similar temperature profile shown in FIG. 4 of a prior-art quartz arc tube having a conventional press-sealed cylindrical body containing the same fill and operating at 100 watts. The prior-art arc tube exhibits less rotational symmetry than the roller-formed arc tube of this invention.

The photometric performance characteristics (at 100 hours) of a group of cylindrical quartz arc tubes are compared with those for conventional quartz arc tubes (press-sealed, cylindrical body) in Table 1 below. Although the luminous efficacies are comparable, the spread in correlated color temperature (CCT) is markedly less, and the color rendering index (CRI) is noticeably improved for the roller-formed cylindrical design of this invention. The metal halide salt chemistry for these arc tubes was of the five-component type described in U.S. Pat. No. 5,694,002 to Krasko et al.

TABLE 1

| | Lumens/Watt | CCT | CRI |
|---|---|---|---|
| Conventional Press-sealed, Cylindrical | 87.1 | 2960 ± 150 | 72.8 |
| Roller-formed Cylindrical | 86.1 | 3036 ± 75 | 86.5 |

While there has been shown and described what are at the present considered the preferred embodiments of the invention, it will be obvious to those skilled in the art that various changes and modifications may be made therein without departing from the scope of the invention as defined by the appended claims.

We claim:

1. A quartz arc tube for a low wattage metal halide lamp comprising:

a quartz body enclosing a discharge chamber having a metal halide till, the discharge chamber having substantially the shape of a right circular cylinder and containing opposing electrodes; the discharge chamber having a nearly symmetric longitudinal face temperature profile when operating at 35–150 watts in a steady-state thermal condition therein the difference between the maximum and minimum temperatures of the profile is less than about 30° C. and the maximum temperature of the profile is less than about 900° C.

2. The arc tube of claim 1 wherein the difference between the maximum and minimum temperatures of the profile is less than about 20° C.

3. The arc tube of claim 1 wherein the arc tube is operated in a vertical orientation.

4. The arc tube of claim 1 wherein the arc tube is operated in a non-vertical orientation using an acoustically-modulated power source.

5. The arc tube of claim 1 wherein the arc tube is operated at an average wall loading of from about 25 to about 40 $W/cm^2$.

6. The arc tube of claim 1 wherein the arc tube when operating exhibits a CRI of greater than about 80.

7. A quartz arc tube for a low wattage metal halide lamp comprising:

a quartz body enclosing a discharge chamber having a metal halide fill, the discharge chamber having substantially the shape of a right circular cylinder and containing opposing electrodes, the opposing electrodes being disposed at each end of the discharge chamber and coaxial with the axis of the chamber, the distance between the opposing electrodes defining an arc length;

the inner diameter of the discharge chamber in centimeters being approximately equal to $[(1P/50)^{1/2}-1]$, where P is the input power in watts and ranges from 35–150 watts; and wherein the ratio of the arc length to the inner diameter is about one.

* * * * *